US005795140A

United States Patent [19]

Jin

[11] Patent Number: 5,795,140

[45] Date of Patent: Aug. 18, 1998

[54] RECIPROCATING COMPRESSOR HAVING CRANKSHAFT WITH LUBRICATION-CONDUCTING GROOVES ON AN OUTER PERIPHERY THEREOF

[75] Inventor: Sun Ik Jin, Suwon, Rep. of Korea

[73] Assignee: Samsung Electronics Co., Ltd., Suwon, Rep. of Korea

[21] Appl. No.: 729,691

[22] Filed: Oct. 7, 1996

[30] Foreign Application Priority Data

Oct. 13, 1995 [KR] Rep. of Korea ..... 95-35404

[51] Int. Cl.[6] ..... F04B 17/00

[52] U.S. Cl. ..... 417/372; 184/6.18; 184/61

[58] Field of Search ..... 184/6.18, 61; 417/372

[56] References Cited

U.S. PATENT DOCUMENTS 3,068,820 12/1962 Ketteren et al. ..... 184/61 X
4,236,877 12/1980 Abe ..... 184/6.18 X
4,568,253 2/1986 Wood ..... 417/372
4,901,819 2/1990 Tamba et al. ..... 184/6.18
5,228,843 7/1993 Novolan et al. ..... 417/372 X

*Primary Examiner*—Timothy Thorpe
*Assistant Examiner*—Ted Kim
*Attorney, Agent, or Firm*—Burns, Doane, Swecker & Mathis, L.L.P.

[57] ABSTRACT

A reciprocating compressor includes a housing in which lubricating oil is stored, and an electric motor for driving a vertical crankshaft connected to a piston for reciprocating the piston. The crankshaft includes an outer peripheral contact surface rotatably mounted in the bearing. An oil passage is formed in the crankshaft, the oil passage having an oil inlet submerged in the oil, and an oil outlet communicating with the contact surface for conducting oil to the contact surface in response to rotation of the crankshaft. The contact surface includes spiral races formed therein in circumferentially spaced relationship to the oil outlet for reducing the size of the contact surface and hence reducing the amount of friction produced between the contact surface and the bearing.

7 Claims, 5 Drawing Sheets

RECIPROCATING COMPRESSOR HAVING CRANKSHAFT WITH LUBRICATION-CONDUCTING GROOVES ON AN OUTER PERIPHERY THEREOF

FIELD OF THE INVENTION

The present invention relates to a reciprocating compressor. More particularly, it relates to the lubrication of a crankshaft which rotates within a bearing.

BACKGROUND OF THE INVENTION

Reciprocating compressors are commonly used for electric household refrigerators to compress a refrigerant gas or vapor under high temperatures and then jet it into capillary tubes in a cooling cycle.

As shown in FIGS. 4 and 5, a conventional reciprocating compressor includes a shell or having 10 which consists of upper and lower casings 11,12 joined together to hermetically seal its interior. Inside of the shell 10 is mounted a driving part 20 and a compressing part 30 which uses the power generated by the driving part 20 to suction and compress refrigerant, and then pump out the compressed refrigerant.

The driving part 20 includes a stator 21, a rotor 22 mounted concentrically within the stator, a rotating crankshaft 23 fitted within the rotor 22, and a crank journal 24 integral with the crankshaft 23 and eccentric from the crankshaft's axis. The driving part 20 also includes a bearing 25 secured to the rotor 22 which supports the crankshaft 23 during its rotation, and a washer 26 which is positioned between the bearing 25 and the rotor 22.

An oil pickup tube 27 is attached to the bottom of the crank journal 24 and feeds lubricating oil to the driving part 20. This oil pickup tube 27 extends upwards to a point below an outlet 40 for oil supply, and the oil is forced upward through the tube, then into the oil supply passage 41 of the crank journal 24 into the outlet 40.

Oil grooves 42 and 43 which supply the lubricating oil to the contact surface 28 between the crankshaft 23 and the bearing 25 are formed extending upward from the outlet 40 to the point above the bearing 25 where the washer 26 lies. An oil bank 44 is forward along the central portion of the crankshaft 23 between the crankshaft's upper oil groove 42 and its lower oil groove 43 so as to regulate the amount of the oil supplied to the crankshaft 23.

The compressing part 30 includes a cylinder 31 that creates the space into which the refrigerant is drawn and then compressed, a piston 32 which makes a reciprocating movement within the cylinder 31, a connecting rod 33 which connects the crank journal 24 to the piston 32 and converts the crankshaft's 23 rotating motion into the reciprocating movement of the piston 32, and a capillary tube 34 which serves to feed the lubricating oil to the compressing part 30.

Once power is applied to the reciprocating compressor, the repulsive power of the magnetic field created between the stator 21 and the rotor 22 causes the crankshaft 23 to rotate. This rotating motion is converted into the piston's 32 reciprocating movement by the connecting rod 33 which couples the crank journal 24 to the piston 32, and thereby causes the piston 32 to reciprocate within the cylinder 31. With the reciprocation of the piston 32 the cylinder suctions and compresses the refrigerant, then discharging it to additional constituents of a cooling unit not discussing in this document.

As the crankshaft 23 rotates, the oil pickup tube 27 attached to the bottom of the crank journal 24 also rotates, thereby generating centrifugal force. The centrifugal force forces the oil upward through the oil supply passage 41 of the crank journal 24 and into the outlet 40. The lubricating oil flows upward through the lower oil groove 43, the oil bank 44, and the upper oil groove 42 formed in the crankshaft 23, and then runs down to join the oil 5 contained in the lower casing 12 along the exterior surface of the bearing 25. This circulation of the lubricating oil is induced by the rotation of the crankshaft 23, and allows the driving part 20 and the compressing part 30 to perform continuous lubricating and cooling operations.

Due to the fact that the crankshaft 23 has only one pair of upper and lower oil grooves on its cylindrical surface, the contact surface 28 is too wide, causing an increase in frictional loss during the rotation of the crankshaft 23. In addition, the high-speed rotation of the crankshaft 23 forces the lubricating oil upwards through the oil grooves in a very short period of time, insufficiently supplying the lubricating oil to the contact surface 28, thereby increasing energetic loss caused by mechanical friction between the moving parts. Simply put, the conventional reciprocating compressor has the disadvantages of a decrease in its mechanical efficiency and the crankshaft's lifetime.

SUMMARY OF THE INVENTION

The present invention may obviate the above-mentioned problems of the conventional art by introducing an improved reciprocating compressor.

It is the objective of the present invention to provide a reciprocating compressor in which a portion of the crankshaft's cylindrical surface is replaced with oil grooves, thereby decreasing frictional resistance and minimizing frictional loss by reducing the size of the contact surface between the crankshaft and the bearing.

In order to achieve the above objective and other advantages, and in accordance with the purpose of the present invention as embodied and broadly described, the present invention's reciprocating compressor includes a shell which hermetically seals the interior of the compressor and contains oil in its bottom; a crankshaft mounted in the shell which rotates by an electric driving means; and a crank journal eccentrically connected to one end of the crankshaft, which serves to convert the rotating motion of the crankshaft into the reciprocating movement of the piston within the cylinder.

The inventive reciprocating compressor also includes a bearing encompassing the exterior surface of the crankshaft and supporting its rotation; an oil pickup tube extending downward from the crank journal so as to feed the oil contained in the shell onto the contact surface between the crankshaft and the bearing; and a plurality of grooves formed on the exterior surface of the crankshaft.

The grooves are spirally formed on the exterior surface of the crankshaft, and some of them may serve as oil supply passages to feed lubrication onto the contact surface between the crankshaft and the bearing. Preferably, these spiral grooves extend in parallel directions.

DESCRIPTION OF THE PREFERRED EMBODIMENT

Figure 1:
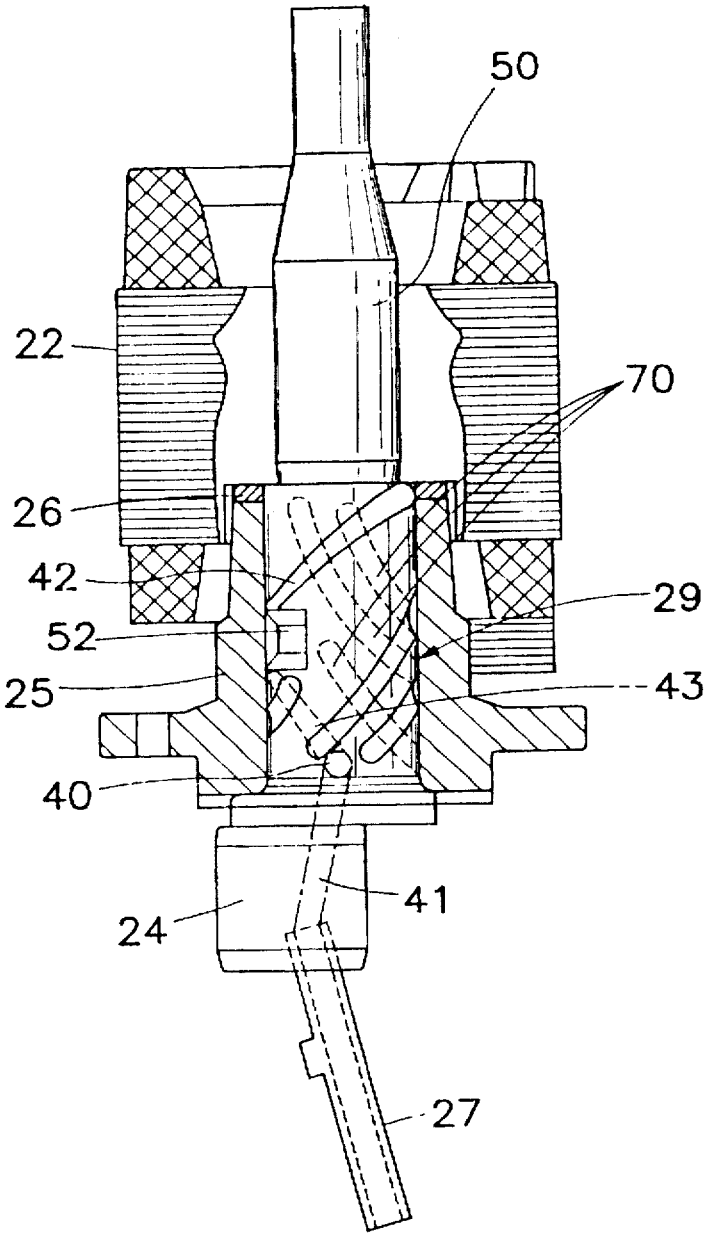
FIG. 1 is a side-sectional view of the crankshaft and bearing of a reciprocating compressor in accordance with the present invention.
Figure 2:
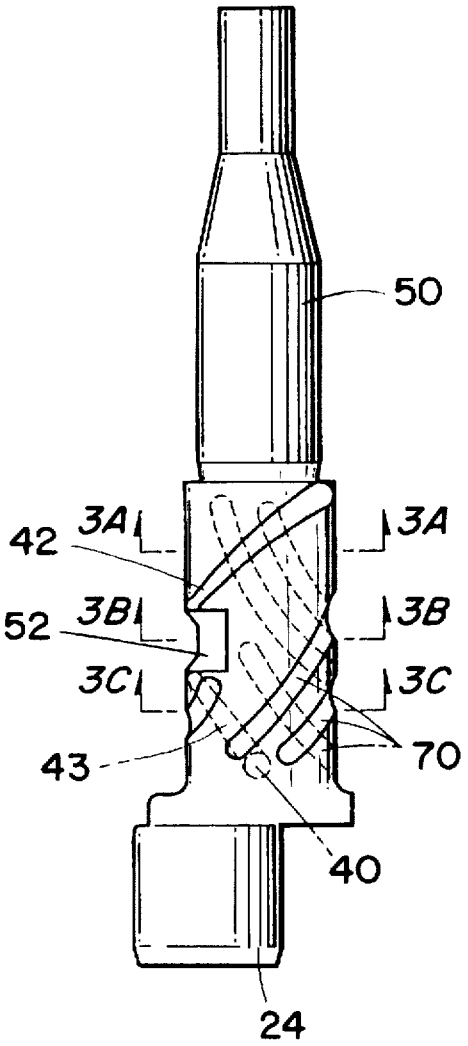
FIG. 2 is a side view of the crankshaft depicted in FIG. 1.
Figure 3A:
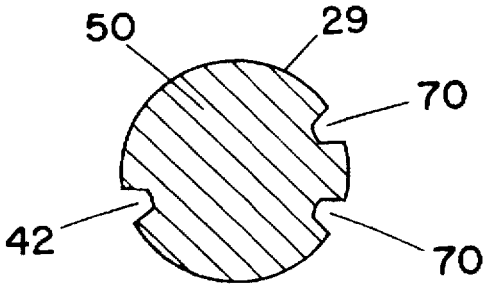
FIG. 3A is a cross-sectional view as taken along line 3A—3A of FIG. 2.
Figure 3B:
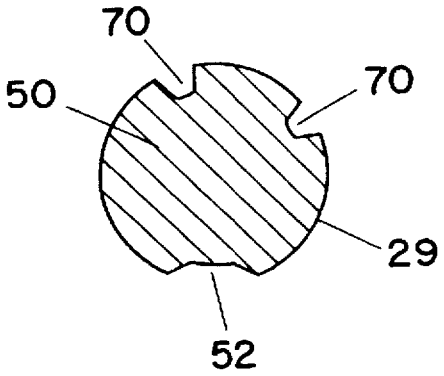
FIG. 3B is a cross-sectional view as taken along line 3B—3B of FIG. 2.
Figure 3C:
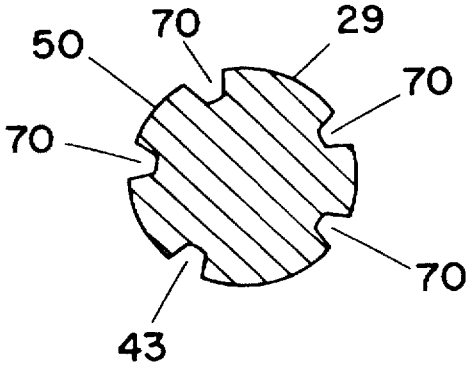
FIG. 3C is a cross-sectional view as taken along line 3C—3C of FIG. 2.

The preferred embodiment of the present invention will now be discussed in detail with reference to the accompanying drawings.

Similar reference numerals denote similar elements throughout the drawings and the specification. Furthermore, redundant explanations of features common between the conventional art and preferred embodiments of this invention are omitted.

As depicted in FIG. 1, the crankshaft 50 has upper and lower oil grooves 42 and 43 on its cylindrical exterior surface which are similar to the conventional art. Under the lower oil groove 43 an outlet 40 of an oil supply passage 41 is provided which passage 41 is connected to an oil pickup tube 27. This 40 is also essentially the same as that of the conventional art.

Between the upper oil groove 42 and the lower oil groove 43 an oil bank or reservoir 52 is mounted for regulating the amount of the oil supplied to the crankshaft 50. Differing from the conventional art, the oil bank 52 is formed on only one side of the crankshaft 50 allowing for the formation of races 70 ( which minimize the effect of friction ) on the cylindrical exterior surface of the crankshaft 50. The combined upper and lower oil grooves 42 and 43 together to have a combined spiral shape of about one pitch from the outlet 40 on the lower section of the crankshaft 50 to its upper section with respect to the oil bank 52.

As one of the major features of the present invention, a plurality of spiral races 70 for minimizing friction between the crankshaft 50 and the bearing 25 are formed on portions of the crankshaft's cylindrical outer surface where the upper and lower oil grooves 42,43 and the oil bank 52 are not formed. These races 70 extended obliquely relative to the axis of rotation so as to cover a wide range of the cylindrical surface of the crankshaft 50.

As depicted in FIGS. 2, 3A, 3B and 3C, the formation of the plurality of races 70 on the exterior surface of the crankshaft 50 halves the size of the contact surface 29. The crankshaft 50 of the present invention, however, is similar to a conventional crankshaft, and consequently there is no significant change in the manufacturing of the crankshaft or production costs.

Figure 4:
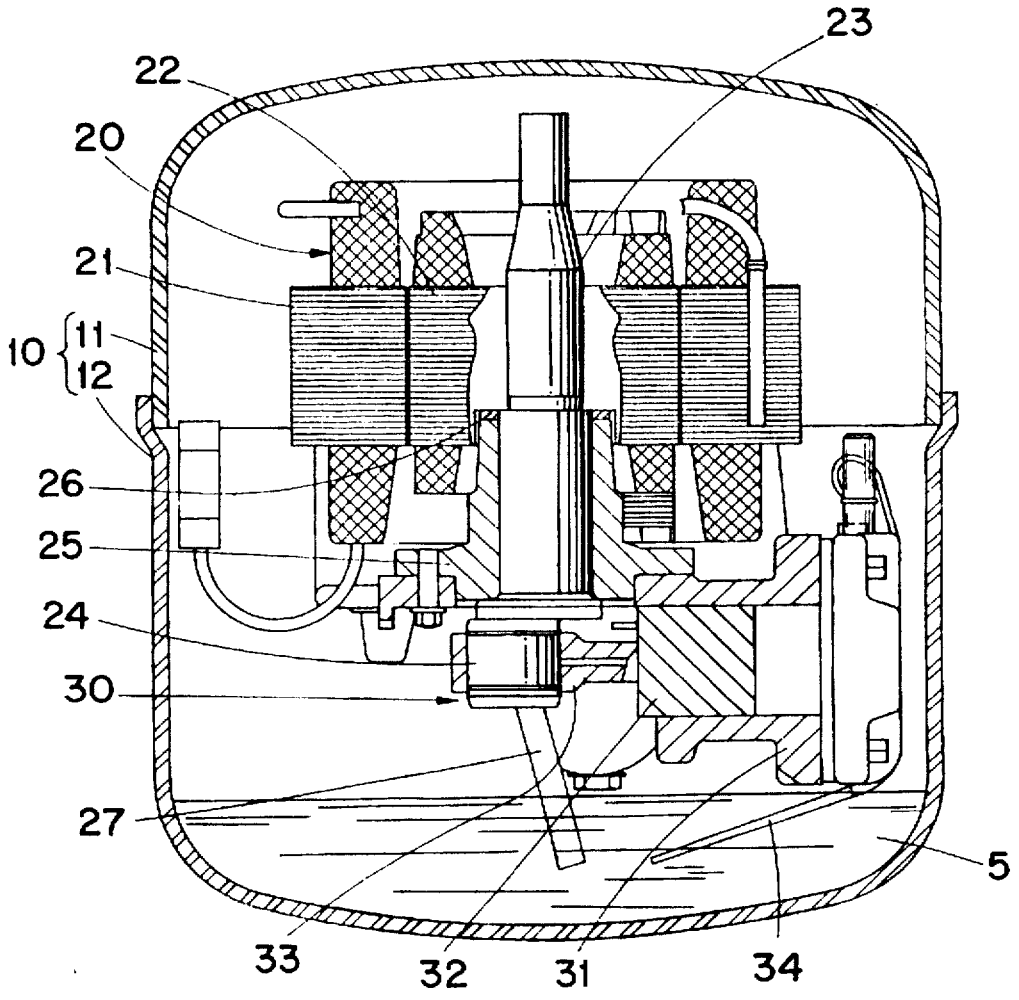
Fig. 4 (PRIOR ART)
FIG. 4 is a side-sectional view of a conventional reciprocating compressor.
Figure 5:
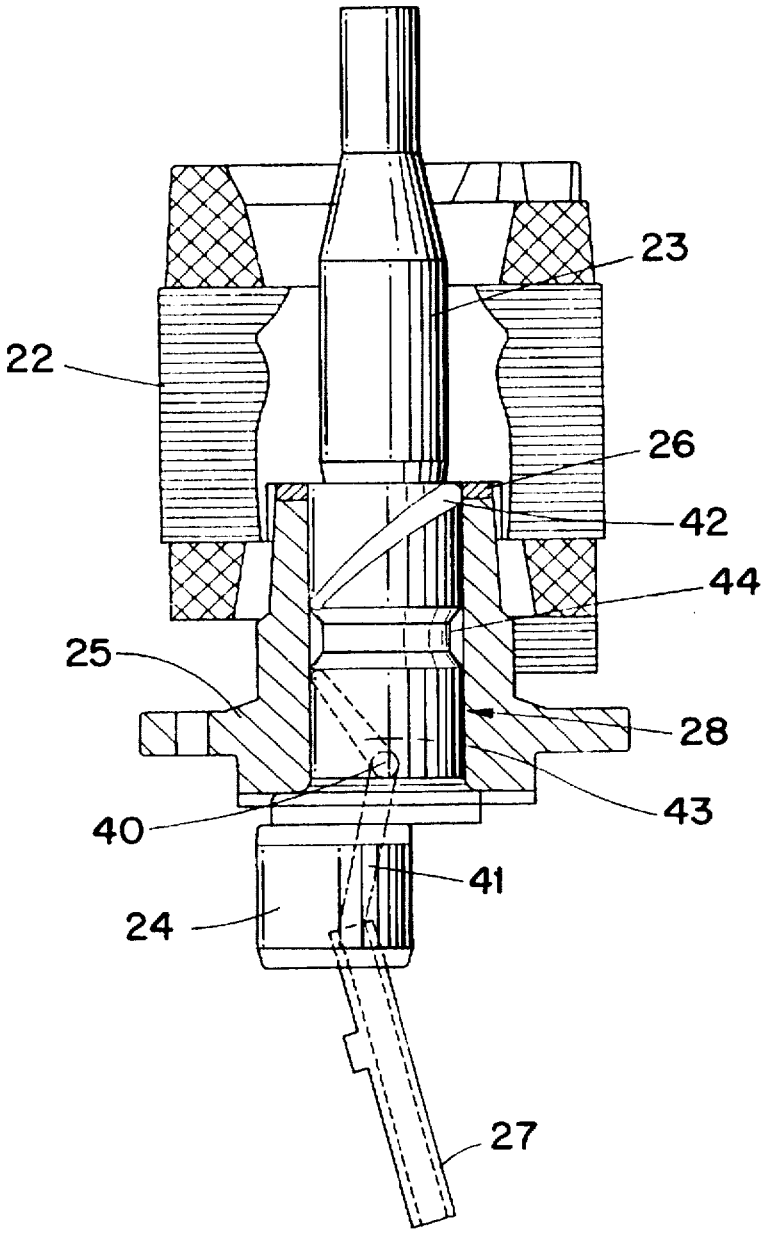
Fig. 5 (PRIOR ART)
FIG. 5 is a side-sectional view of a crankshaft and a bearing of the compressor depicted in FIG. 4.

The following description relates to the lubrication of the inventive reciprocating compressor. Centrifugal force generated by the rotation of the crankshaft 50 forces upwards lubricating oil 5 contained in the lower section of the shell 10 housing (refer to FIG. 4) through the oil pickup tube 27 attached to the bottom of the crank journal 24. The lubricating oil 5 then flows through the outlet 40 and is forced upwards into the spiral grooves 42,43 and then forms an oily film over the contact surface 29 of the bearing 25 with the crankshaft 50 to provide lubrication and cooling. The pumping action created by the continuous rotation of the crankshaft 50 forces the oil upwards to the upper oil groove 42, and then the oil overflows to the outside of the bearing 25 and returns to the lower section of the shell 10 by force of gravity.

The contact surface 29 is reduced in size by the formation a plurality of races 70, thereby minimizing frictional loss, and therefore enhancing the compressor's mechanical efficiency. Moreover, the lubricating oil 5 flows through the races 70, providing adequate lubrication to the contact surface 29 of the crankshaft 50 with the bearing 25. According to the inventive reciprocating compressor, the frictional resistance between the crankshaft and the bearing rotatably supporting the crankshaft may be reduced thereby decreasing power consumption.

What is claimed:

1. A reciprocating compressor, comprising:

a housing forming a hermetically sealed space, with oil stored at a bottom thereof;

a cylinder disposed in the space and forming a compression chamber;

a piston mounted in the compression chamber;

a bearing disposed in the space;

an electric motor disposed in the space;

a vertical crankshaft including an outer peripheral contact surface rotatably mounted in the bearing and connected to the motor to be rotated thereby;

a crank journal eccentrically connected to the crankshaft and connected to the piston to convert rotation of the crankshaft into reciprocation of the piston, the crank journal including an internal oil supply passage;

an oil pickup tube extending downwardly from the crank journal and into the stored oil to feed oil upwardly to the internal oil supply passage in response to rotation of the crankshaft;

an oil groove formed in the contact surface and communicating with the internal oil supply passage to conduct oil and lubricate the contact surface;

a race formed in the contact surface in circumferentially spaced relationship to the oil groove for reducing the size of the contact surface; and an oil reservoir formed in the contact surface and intersecting the oil groove, the reservoir extending circumferentially for less than the entire circumference of the contact surface.

2. The reciprocating compressor according to claim 1 wherein a lower end of the race is situated below the reservoir, and an upper end of the race is situated above the reservoir.

3. The reciprocating compressor according to claim 2, wherein the oil groove extends generally spirally along the contact surface and is intersected by the reservoir intermediate upper and lower ends of the oil groove.

4. The reciprocating compressor according to claim 3 wherein there are a plurality of races spaced circumferentially apart.

5. The reciprocating compressor according to claim 1 wherein the oil groove and the race extend spirally.

6. The reciprocating compressor according to claim 5 wherein there are a plurality of races spaced circumferentially from one another.

7. The reciprocating compressor according to claim 1 wherein the oil groove extends spirally.

* * * * *